United States Patent [19]

Finch

[11] Patent Number: 4,759,725

[45] Date of Patent: Jul. 26, 1988

[54] ELECTRICAL WIRING FIXTURE

[76] Inventor: Don Finch, P.O. Box 109, Coatesville, Ind. 46121

[21] Appl. No.: 112,301

[22] Filed: Oct. 26, 1987

[51] Int. Cl.[4] ..... H01R 4/26

[52] U.S. Cl. ..... 439/439; 439/535; 439/557

[58] Field of Search ..... 439/535, 557, 436–441

[56] References Cited

U.S. PATENT DOCUMENTS

| | | | |
|---|---|---|---|
| Re. 26,994 | 12/1970 | Fuller | 174/84 |
| 3,193,613 | 7/1965 | Van Buren | 439/557 |
| 3,656,087 | 4/1972 | Nutton | 439/438 |
| 3,746,373 | 7/1973 | Prudente | 439/557 X |
| 4,561,179 | 12/1985 | Brush | 29/866 |

*Primary Examiner*—Eugene F. Desmond
*Attorney, Agent, or Firm*—John H. Calhoun, Jr.

[57] ABSTRACT

An electrical wiring fixture comprising a fixture body having integral therewith a first socket, a second socket and a third socket wherein the said first and second sockets extend outward from opposite sides of the said fixture body and wherein the said third socket extends outward laterally from the said fixture body; and wherein each of the said sockets is provided with a plug that extends outward therefrom and that is adapted to be inserted into a knockout hole in a wiring box and adapted to couple the said fixture to the said wiring box, each plug of a socket comprising a plurality of tapered spring projections integral with the socket and that extend outward from the socket and that are adapted to deflect inward when the outer ends of the said tapered spring projections are inserted into a knockout hole in a wiring box and are pressed into the said hole.

2 Claims, 2 Drawing Sheets

ELECTRICAL WIRING FIXTURE

BACKGROUND OF THE INVENTION

The present invention relates to an improved electrical wiring fixtures, that is devices that are used for connecting electrical wires to one another or to sockets, switches, outlet boxes or the like. The electrical wiring device of the present invention is adapted to be used with electrical wiring boxes of the kind commonly used for wiring buildings and the like. The wiring device of the present invention may be pre-wired to a socket, switch or other boxed device, and on-site connection to the boxed device may be accomplished by merely inserting the bare ends of electrical conductor wires into sockets provided in the present invention.

Electrical wiring devices are known in the prior art as illustrated by U.S. Reissue Pat. No. 26,994 issued to G. A. Fuller, et al. on Dec. 1, 1970 which shows an electrical connector having a resilient conductor-engaging area.

Applicant is also aware of U.S. Pat. No. 4,561,179 which issued to Robert W. Brush, Jr. et al. on Dec. 31, 1985 for a method of electrical connection to the center conductor of an insulated wire.

On June 15, 1971 U.S. Pat. No. 3,585,570 issued to John T. Jans for an electrical terminal assembly, and on Feb. 29, 1972 U.S. Pat. No. 3,646,499 issued to Don L. DeLano for a multiple connector. U.S. Pat. No. 1,290,153 issued on Jan. 7, 1919 to J. Fitzpatrick.

The present invention provides a novel and useful electrical wiring device that can be used in connection with standard electrical wiring boxes for sockets and switches commonly found in residences and other types of structures to facilitate the quick wiring of such boxes without the need for any tools other than a wire stripper.

SUMMARY OF THE INVENTION

The electrical wiring device of the present invention has many of the advantages of electrical wiring devices known in the prior art, and in addition it provides several distinct and important advantages not found in previously known electrical wiring devices.

A common problem with the wiring of residences and the like using boxes and wiring devices heretofore known in the art is the difficulty of performing wiring operations in a very confined space, which results in increased risk of making poor connections that may later overheat.

A primary objective of the present invention is to provide an electrical wiring device that will facilitate the wiring of residences and the like.

Another objective of the present invention is to provide an electrical wiring device to which electrical wires may be safely, quickly, and easily connected without the use of any hand tools other than a suitable wire stripper.

Another objective of the present invention is to provide an electrical wiring device that can be factory-wired to electrical wiring boxes, thus obviating the necessity for making on-site connections inside electrical wiring boxes.

Another object of the present invention is to provide an electrical wiring device that is simple in construction, inexpensive, strong and durable, and well adapted for the purposes for which it is designed.

Other objects and advantages of the present invention will become apparent from a consideration of the following detailed description taken in connection with the accompanying drawings wherein a preferred embodiment of the invention are shown.

It should be understood that the invention is not limited to the details disclosed, but includes all such variations and modifications as fall within the spirit of the invention and the scope of the appended claims.

This invention contemplates electrical wiring devices of different sizes for use with different size electrical conductor wires.

The objectives of the present invention are accomplished by providing a "T" shaped electrical wiring device comprising a plurality of three-way electrical connectors encapsulated in an insulator body that is adapted to be rapidly coupled to an electrical wiring box and having provided therein access openings through which the ends of electrical wires may be inserted to be engaged by the said three-way electrical connectors.

BRIEF DESCRIPTION OF THE DRAWINGS

A preferred embodiment of the present invention is illustrated in the accompanying drawings in which.

DESCRIPTION OF THE PREFERRED EMBODIMENT

Figure 1:
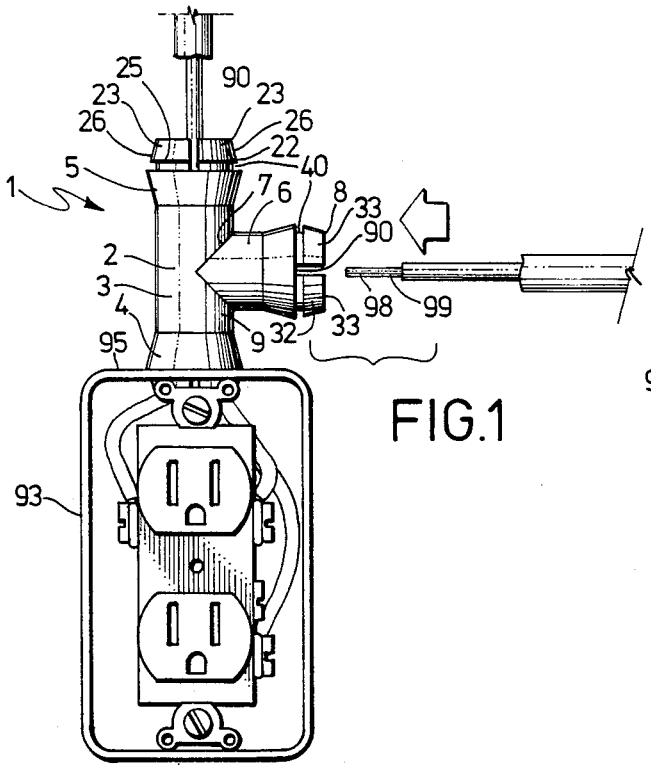
FIG. 1 is a front elevation view of the wiring device of the present invention assembled to the top of a standard outlet box.
Figure 2:
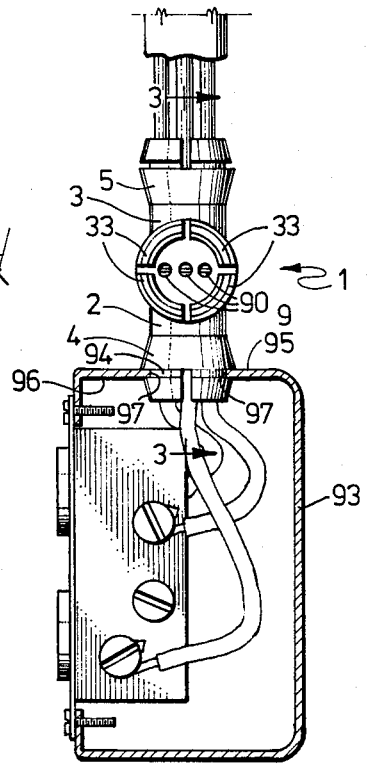
FIG. 2 is a front elevation view of the wiring device of the present invention assembled to the top of a standard outlet box.
Figure 3:
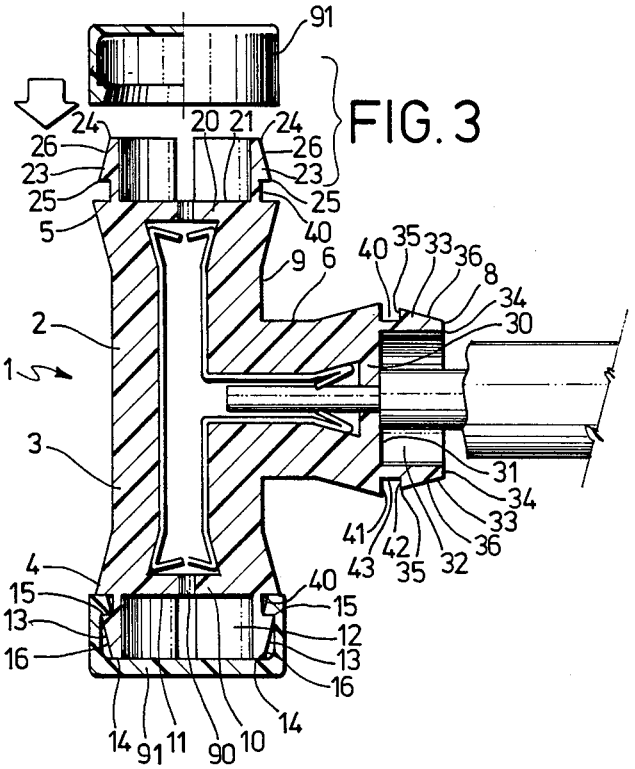
FIG. 3 is a sectional view of the wiring device of the present invention taken along 3—3 of FIG. 2.

Referring now to the drawings in greater detail, FIGS. 1, 2, and 3 illustrate the electrical wiring device of the present invention shown generally at 1. The wiring device 1 comprises a "T" shaped insulator body 2 comprising a first cylindrical member 3 having opposing ends 4, 5 and a second cylindrical member 6 having opposing ends 7, 8, wherein the said second member 6 extends outward laterally from the side 9 of the first member 3 and is integral with the said first member 3.

A plug and socket assembly is provided at each exposed end 4, 5, 8 of the insulator body 2. Each plug 12, 22, 32 comprises a plurality of resilient tapered spring projections 13, 23, 33 that are arranged around the perimeters of the respective sockets 10, 20, 30 and that are integral with and extend outward lengthwise from the respective ends 11, 21, 31 of the respective sockets 10, 20, 30 which are provided at the exposed ends 4, 5, 8 of the insulator body 2. The plugs 12, 22, 32 are adapted to be inserted into any knockout hole 94 in any electrical wiring box 93 and to securely couple the wiring device 1 to the box 93. The ends 14, 24, 34 of the tapered spring projections 13, 23, 33 are adapted to be inserted into any hole 94 in any electrical wiring box 93, and to deflect laterally inward when a plug 12, 22, 32 is pressed into a knockout hole 94. Each plug 12, 22, 32 is provided with a three-sided annular recess 40 at the base 15, 25, 35 of spring projections 13, 23, 33 comprising the said plug 12, 22, 32. A first side 41 of each annular recess 40 is adapted to encircle a knockout hole 94 in an electrical wiring box 93 and to seat against the outside surface 95 of the box 93. A second side 42 of each annular recess 40 opposes the first side 41 of the said annular recess 40 and is adapted to encircle any knockout hole 94 in an electrical wiring box 93 and to seat against the inside surface 96 of the box 93. The third side 43 of each annular recess 40 extends between and is integral with the said first and second sides 41, 42 of the annular recess 40 and is adapted to fit snugly against the inside edge 97 of a knockout hole 94 in an electrical wiring box 93.

To assemble an electrical wiring device 1 of the present invention to an electrical wiring box 93 one merely inserts the ends 14, 24, 34 of the tapered spring projections 13, 23, 33 of one of the plugs 12, 22, 32 into a knockout hole 94 in a box 93 and then pushes the tapered spring projections 13, 23, 33 into the hole 94. The edge 97 of the hole 94 engages the sides 16, 26, 36 of the tapered spring projections 13, 23, 33 and applies an increasing inward pressure against the projections 13, 23, 33 as the projections are pressed into the hole 94. The projections 13, 23, 33 deflect inward under the pressure exerted against them by the edge 97 of the hole 94 as the projections are pressed into the hole 94. When the bases 15, 25, 35 of the projections enter the hole 94, inward pressure on the projections 13, 23, 33 is released, and the tapered spring projections 13, 23, 33 return to their normal spread-apart positions. The edge 97 of the hole 94 is firmly gripped by the three sides 41, 42, 43 of the annular recess 40. The two opposing surfaces 41, 42 of the recess 40 grip the outer and inner surfaces 95, 96 of the box 93 and the inside surface 43 of the annular recess 40 engages the edge 97 of the hole 94. In this manner, the electrical wiring device 1 of the present invention may be quickly, easily, and firmly secured to the box 93.

Figure 4:
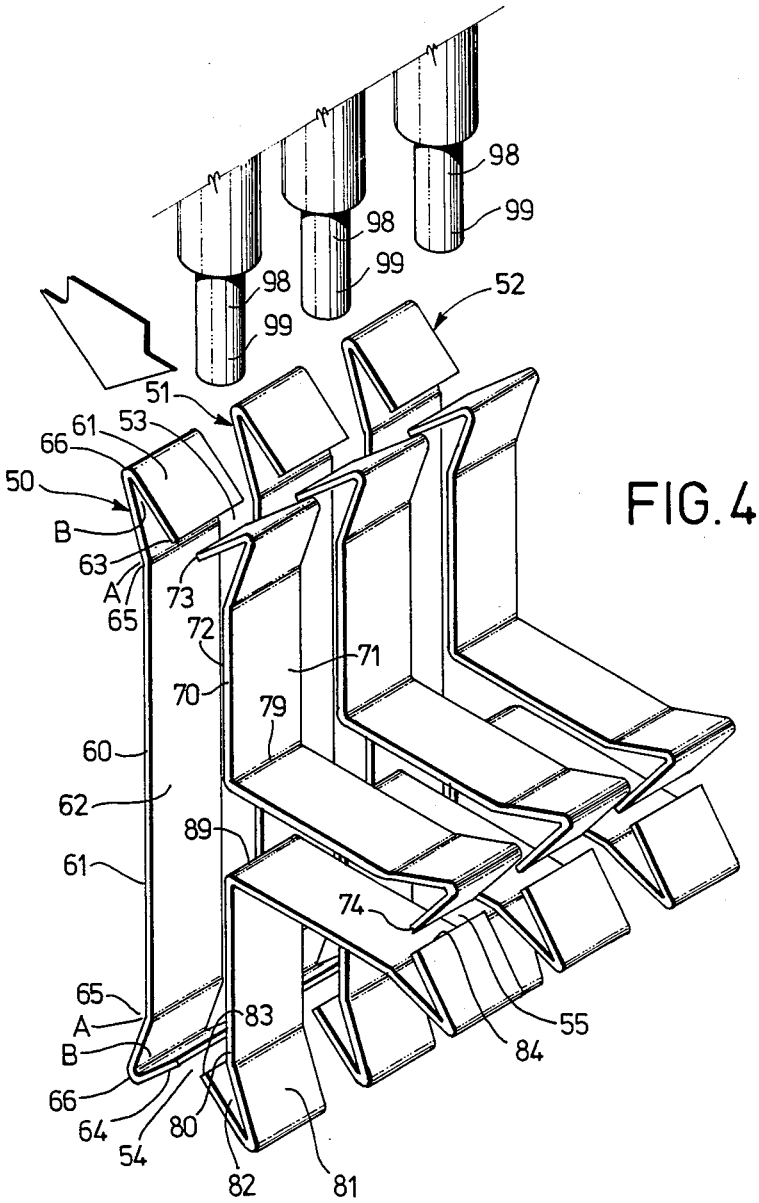
FIG. 4 is an exposed view in perspective of the conductor strip assemblies of the present invention.

Also provided is plurality of like three-way electrical connectors 50, 51, 52, best illustrated in FIGS. 3 and 4. Each three-way electrical connector 50, 51, 52 comprises a first resilient electrical conductor strip 60 having an electrical contact surface 61, a non-contact surface 62, a first end 63 and a second end 64; a second resilient electrical conductor strip 70 having an electrical contact surface 71, a non-contact surface 72, a first end 73 and a second end 74; and a third resilient electrical conductor strip 80 like the second resilient electrical conductor strip 70 and having an electrical contact surface 81, a non-contact surface 82, a first end 83 and a second end 84.

Each end 63, 64, 73, 74, 83, 84 of each conductor strip 60, 70, 80 is adapted by forming in the manner described below to cooperate with a like end of another conductor strip to form an electrical spring connector 53, 54, 55.

A first bend 65 is provided in the said first conductor strip 60 across the width thereof to form an oblique interior angle A in the contact surface 61 of the strip 60 near the first end 63 thereof. A second bend 66 is provided in the said first conductor strip 60 across the width thereof and between the said first bend 65 and the end 63 of the said strip 60 to form an acute interior angle B in the non-contact surface 62 of the strip 60. The end 63 of the strip 60 thus formed comprises one-half of an electrical connector 53 which is more fully described below.

The other end 64 of the first conductor strip 60 is provided in like manner with a first bend 65 and a second bend 66 across the width of the said strip 60 near the other end 64 of the said strip 60 to form oblique and acute interior angles A and B in the contact and non-contact surfaces 61, 62 respectively of the said end 64 of the said strip 60 thus adapting the said end 64 of the said strip 60 to cooperate with a like end 73, 74, 83, 84 of a second or third conductor strip 70, 80 to form an electrical connector 54.

In like manner, both ends 73, 74, 83, 84 of the second and third conductor strips 70, 80 are provided with first and second bends across the widths thereof to form oblique and acute angles A and B in the contact and non-contact surfaces 71, 72, 81, 82 of the said strips. In addition, the second and third conductor strips 70, 80 are each provided with a fifth bend 79, 89 across the width thereof, and in the illustrated embodiment the said fifth bends 79, 89 form right interior angles in the contact surfaces 71, 81 of the respective conductor strips 70, 80.

Each three-way electrical connector comprises a first, a second and a third electrical conductor strip 60, 70, 80 formed in the manner previously disclosed and held in opposing spaced apart relationships relative to each other in such manner that the non-contact surfaces 72, 82 of the second and third conductor strips 70, 80 face and oppose the non-contact surface 62 of the said first strip 60 and the non-contact surfaces 72, 82 of the said second and third conductor strips 70, 80 face and oppose each other.

The first formed end 63 of the first conductor strip 60 opposes the first formed end 73 of the second conductor strip 70 and the two ends 63, 73 are adapted to cooperate with each other to form a first electrical spring connector 53, the said ends 63, 73 being adapted to receive inserted lengthwise therebetween an electrical conductor wire 98 and adapted to cooperate with each other to engage the said wire 98 and adapted to retain the said wire 98 and adapted to make electrical spring contact with the surface 99 of the wire 98.

The second formed end 64 of the first conductor strip 60 opposes the first formed end 83 of the third conductor strip 80 and the two ends 64, 83 are adapted to cooperate with each other to form a second electrical spring connector 54, the said ends 64, 83 being adapted to receive inserted lengthwise therebetween an electrical conductor wire 98 and adapted to cooperate with each other to engage the said wire 98 and adapted to retain the said wire 98 and adapted to make electrical spring contact with the surface 99 of the wire 98.

The second formed end 74 of the second conductor strip 70 opposes the second formed end 84 of the third conductor strip 80 and the two ends 74, 84 are adapted to cooperate with each other to form a third electrical spring connector 55, the said ends 74, 84 being adapted to receive inserted lengthwise therebetween an electrical conductor wire 98 and adapted to cooperate with each other to engage the said wire 98 and adapted to retain the said wire 98 and adapted to make electrical spring contact with the surface 99 of the wire 98.

In the illustrated embodiment three like three-way electrical connectors 50, 51, 52 are provided, and the said three-way connectors 50, 51, 52 are held in spaced apart relationship relative to each other. The three three-way connectors are encapsulated in the body 2 of the electrical wiring device 1. A plurality of access holes 90 are provided in the ends 11, 21, 31 of the respective sockets 10, 20, 30. The said access holes 90 extend lengthwise into the ends 11, 21, 31 of the said sockets 10, 20, 30 and are aligned with the said electrical spring connectors 53, 54, 55. A bare end of an electrical conductor wire 98 may be inserted lengthwise into any access hole 90 in any socket 10, 20, 30 and into the spring connector 53, 54, 55 aligned with the access hole 90.

Also provided is a cap 91 that is adapted to fit over the end of any plug 12, 22, 32 and to seal the plug 12, 22, 32 when the plug 12, 22, 32 is not being used.

Electrical wiring devices of the present invention may be installed on electrical wiring boxes at factories, away from job sites, or at job sites. Devices within electrical wiring boxes, such as switches or sockets, may be pre-wired to the wiring device of the present invention. Pre-wired assemblies may be installed at job sites. Wiring after installation of the assemblies would be limited to stripping and inserting the ends of electrical conductor wires into the sockets of the wiring fixture of the present invention, thus simplifying and expediting the in-place wiring of boxes.

Having thus described my invention, what I now claim is:

1. An electrical wiring fixture comprising a fixture body having integral therewith a first socket, a second socket and a third socket wherein the said first and second sockets extend outward from opposite sides of the said fixture body and wherein the said third socket extends outward laterally from the said fixture body; and wherein each of the said sockets is provided with a plug that extends outward therefrom and that is adapted to be inserted into a knockout hole in a wiring box and adapted to couple the said fixture to the said wiring box, each plug of a socket comprising a plurality of tapered spring projections integral with the socket and that extend outward from the socket and that are adapted to deflect inward when the outer ends of the said tapered spring projections are inserted into a knockout hole in a wiring box and are pressed into the said hole.

2. A T-shaped electrical fixture comprising a fixture body comprising a first cylindrical insulator member and a second cylindrical insulator member that intersects with and extends laterally from the said first insulator member, the said fixture body having integral therewith a first socket, a second socket and a third socket wherein the said first and second sockets extend outward from opposite sides of the said fixture body and wherein the said third socket extends outward laterally from the said fixture body; and wherein each of the said sockets is provided with a plug that extends outward from the end of the said socket and that is adapted to be inserted into a knockout hole in an electrical wiring box and is adapted to couple the said fixture to the said electrical wiring box, each plug comprising a plurality of tapered spring projections around the perimeter of the said socket and integral with the said socket from which they extend longitudinally outward and that are adapted to deflect laterally inward when the outer ends of the said tapered spring projections are inserted into a knockout hole in an electrical wiring box and are pressed into the said knockout hole and a three sided annular recess provided at the base of the said plurality of tapered spring projections wherein a first side of the said annular recess is adapted to encircle a knockout hole in an electrical wiring box and to seat against the outside surface of the said electrical wiring box and wherein a second side of the said annular recess opposite the said first side of the said annular recess is adapted encircle the said knockout hole in the said electrical wiring box and to seat against the inside surface of the said electrical wiring box, and wherein the said third side of the said annular recess is adapted to fit snugly within the said knockout hole in the said electrical wiring box; a plurality of three-way electrical connectors, each connector comprising first, second and third resilient electrical conductor strips, each strip having an electrical contact surface and a back surface and wherein the said second and third conductor strips are each bent across the width thereof to form an interior contact surface angle of approximately ninety (90) degrees and wherein each end of each conductor strip is provided with a first bend across the width thereof to form an oblique interior contact surface angle and is provided between the said first bend and the end end of the strips with a second and reverse bend across the width thereof to form an acute interior back surface angle, and wherein the each end of each resilient conductor strip thus formed comprises one-half of a resilient electrical contact, and wherein the said resilient conductor strips are held in opposing spaced apart relationship relative to one another such that the reverse surfaces of the bodies of the said second and third conductor strips face the reverse side of the said first conductor strip and wherein the said reverse surface of the body of the said second conductor strip faces the reverse side of the said third conductor strip and wherein the said reverse surface of the body of the said third conductor strip faces the reverse side of the said second conductor strip and wherein a first formed end of the said first conductor strip opposes a first formed end of the said second conductor strip and wherein the said first ends of the said first and second conductor strips form a first electrical spring contact and the said ends are adapted to receive therebetween an electrical conductor wire and are adapted to cooperate with each other to engage the surface of the said electrical conductor wire and to restrain the said electrical conductor wire and to make electrical contact with the said electrical conductor wire, and wherein a second formed end of the said first conductor strip opposes a first formed end of the said third conductor strip and wherein the said second and first ends of the said first and third conductor strips form a second electrical spring contact and the said ends are adapted to receive therebetween an electrical conductor wire and are adapted to cooperate with each other to engage the surface of the said electrical conductor wire and to restrain the said electrical conductor wire and to make electrical contact with the said electrical conductor wire, and wherein a second formed end of the said second conductor strip opposes a second formed end of the said third conductor strip and wherein the said second ends of the said second and third conductor strips form a third electrical spring contact and the said ends are adapted to receive therebetween an electrical conductor wire and are adapted to cooperate with each other to engage the surface of the said electrical conductor wire and to restrain the said electrical conductor wire and to make electrical contact with the said electrical conductor wire, and wherein the said three three-way electrical connectors are held in spaced apart relationship relative to each other and are embedded within the said insulator body and wherein a plurality of socket holes are in each end of each of the said sockets which holes are adapted to to receive an electrical conductor wire inserted lengthwise therein and into one of the said spring contacts; and a cap adapted to fit over and close any unused socket.

* * * * *